US010017307B2

(12) United States Patent
Wang

(10) Patent No.: US 10,017,307 B2
(45) Date of Patent: Jul. 10, 2018

(54) DISPLAY CONTAINER

(71) Applicant: ARIA PRODUCTS L.L.C., Dover, DE (US)

(72) Inventor: Daniel Wang, Chung Hua Hsien (TW)

(73) Assignee: ARIA PRODUCTS, L.L.C., Dover, DE (US)

( * ) Notice: Subject to any disclaimer, the term of this patent is extended or adjusted under 35 U.S.C. 154(b) by 302 days.

(21) Appl. No.: 15/133,532

(22) Filed: Apr. 20, 2016

(65) Prior Publication Data

US 2017/0305624 A1 Oct. 26, 2017

(51) Int. Cl.

| | |
|---|---|
| ***B65D 25/04*** | (2006.01) |
| ***B65D 71/16*** | (2006.01) |
| ***B65D 5/02*** | (2006.01) |
| ***B65D 71/22*** | (2006.01) |
| ***B65D 71/12*** | (2006.01) |

(52) U.S. Cl.

CPC ..... *B65D 71/16* (2013.01); *B65D 5/0254* (2013.01); *B65D 71/12* (2013.01); *B65D 71/22* (2013.01)

(58) Field of Classification Search

CPC ..... B65D 71/16; B65D 5/0254; B65D 71/12; B65D 71/22; B65D 71/125; B65D 5/4204; B65D 2571/00314; B65D 71/246

USPC ..... 229/120.32, 120.21, 164, 120.06, 150, 229/162.1, 162.7; 206/736, 737, 740, 206/745, 776

See application file for complete search history.

(56) References Cited

U.S. PATENT DOCUMENTS

| | | | |
|---|---|---|---|
| 3,161,288 | A | 12/1964 | Wagner |
| 3,253,769 | A | 5/1966 | Opler |
| 2008/0093258 | A1 | 4/2008 | Kim |

*Primary Examiner* — Christopher Demeree

(74) *Attorney, Agent, or Firm* — Muncy, Geissler, Olds & Lowe, P.C.

(57) ABSTRACT

A display container includes a rear panel, two side panels, a first support structure enclosing first edges of the two side panels and the rear panel, two reinforcement arms extending the two side panels respectively and interlocking with each other, and a reception cavity formed thereby. The display container is featured that the first support structure is foldable along fold lines and formed by at least a first planar panel, a face panel, and a foot flap in order. The foot flap retains against any piece of the first support structure. Therefore, the article is accommodated inside the reception cavity.

15 Claims, 11 Drawing Sheets

DISPLAY CONTAINER

BACKGROUND

1. Technical Field

The present disclosure relates to a display container, specifically to a display container by folding sheets of material.

2. Background of the Invention

For display packaging, it is well-known to provide an opening whereby the consumer can tactilely and visually check the articles. Typically such opening creates challenge in maintaining the structural strength of the display packaging.

U.S. Pat. Nos. 3,161,288 and 3,253,769 and U.S. Application 20080093258 each discloses a non-rectilinear display container with an opening. Due to structural consideration, the opening is relatively small.

In the interest of manufacturing economy and attractive merchandising, a display container for an irregular article needs to provide a large opening for tactile and visual check, offer a quick packaging process, and preferably be constructed from one unitary packaging blank.

SUMMARY

It is therefore for one or more aspects to provide a display packaging which is formed by folding sheets of material, with an opening as large as possible for allowing visual and tactile check of a specific face of an article.

It is therefore for one or more aspects to provide a display packaging that firmly accommodates an article to protect the article from being lost or stolen.

It is therefore for one or more aspects to provide a display packaging that can be erected easily without the tendency of the container "unfolding" itself.

It is therefore for one or more aspects to provide a display packaging that is environmentally friendly due to minimal material usage and no use of plastics.

To achieve objects of the present disclosure, a display container including a rear panel, two side panels, a first support structure, two reinforcement arms, and a reception cavity is disclosed. The rear panel defines a first transversal edge, a second transversal edge opposite to the first transversal edge, and two lateral edges. The two side panels are approximately symmetrical with each other, wherein each of the side panels defines a rear edge, a front edge opposite to the rear edge, a first edge, and a second edge opposite to the first edge. The first support structure is disposed adjacent to the first transversal edge of the rear panel and encloses the first edges of the two side panels. The first support structure is folded via an extension sheet, whereon plural of primary fold lines are defined and generally parallel with one another. The primary fold lines intersects the extension sheet and spacing one another with predetermined distances to define a first planar panel extending from the first transversal edge of the rear panel, a face panel extending and foldable from the first planar panel, and a foot flap paralleling with either the face panel or one of the side panels after completing folding the first support structure. Two reinforcement arms respectively extend from the front edges of the two side panels and interlock with each other for being overlaid by the face panel. The reception cavity is defined by at least the rear panel, the two side panels, and the first support structure, and the reception cavity accommodates the article therein.

To achieve objects of the present disclosure, a packaging blank capable of forming a display container is disclosed. The packaging blank includes a primary section, two side sections, a secondary section, means for reinforcement connecting the two side panels, and a glue flap. A plurality of sectional fold lines are set between any adjacent two of the primary section, the two side sections, the secondary section, means for reinforcement, and the glue flap. The primary section has a plurality of primary fold lines generally parallel with one another and intersected thereon to at least define a rear panel and an extension sheet. The rear panel defines a first transversal edge, a second transversal edge opposite to the first transversal edge, and two lateral edges. The extension sheet extends from the first transversal edge of the rear panel, and is intersected into a first planar panel, a face panel extending from the first planar panel, a first interior panel extending from the face panel, and a foot flap extending from the first interior panel. Each of the two side sections defines at least a side panel, wherein each of the side panels defines a rear edge, a front edge opposite to the rear edge, a first edge, and a second edge opposite to the first edge. At least one of the rear edge connects a respective one of the two lateral edges of the rear panel. The secondary section at least defines two reinforcement arms respectively extending from the front edges of the two side panels, wherein the two reinforcement arms are capable of interlocking with each other. A plurality of sectional fold lines are set between any adjacent two of the primary section, the two side sections, the secondary section, and the glue flap.

To achieve objects of the present disclosure, a packaging blank capable of forming a display container is disclosed. The packaging blank includes a primary section, two side sections, a secondary section, means for reinforcement connecting the two side panels, and a glue flap. A plurality of sectional fold lines are set between any adjacent two of the primary section, the two side sections, the secondary section, means for reinforcement, and the glue flap. The primary section has a plurality of primary fold lines generally parallel with one another and intersected thereon to at least define a rear panel and an extension sheet. The rear panel defines a first transversal edge, a second transversal edge opposite to the first transversal edge, and two lateral edges. The extension sheet extends from the first transversal edge of the rear panel, and is intersected into a first planar panel, a face panel extending from the first planar panel, and a foot flap extending from the face panel. Each of the two side sections defines at least a side panel; wherein each of the side panels defines a rear edge, a front edge opposite to the rear edge, a first edge, and a second edge opposite to the first edge. At least one of the rear edge connects a respective one of the two lateral edges of the rear panel. The secondary section at least defines two reinforcement arms respectively extending from the front edges of the two side panels, wherein the two reinforcement arms are capable of interlocking with each other. A plurality of sectional fold lines are set between any adjacent two of the primary section, the two side sections, the secondary section, and the glue flap.

Other advantages and features of the present disclosure will be fully understood by reference to the following specification in conjunction with the accompanying drawings, in which like reference signs denote like components of structure.

DETAILED DESCRIPTION OF THE DISCLOSURE

Figure 1:
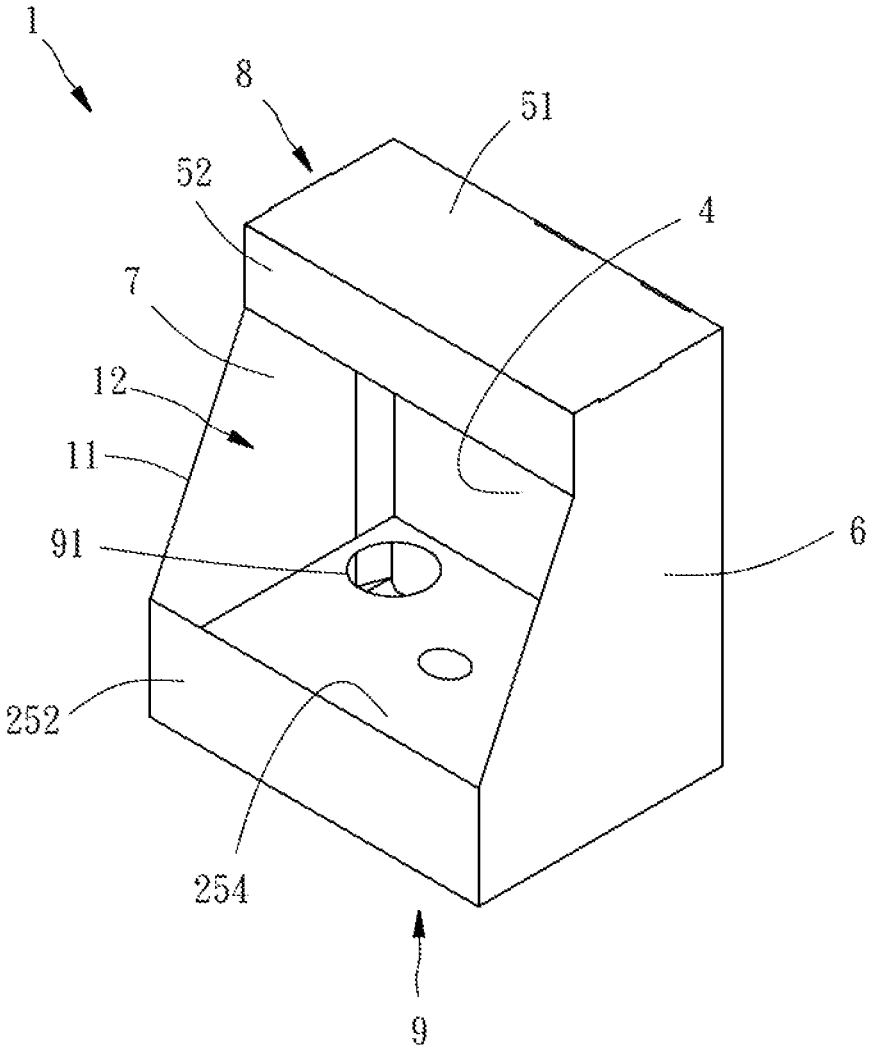
FIG. 1 is a perspective view illustrating a display container in accordance to a first embodiment of the present disclosure.
Figure 8:
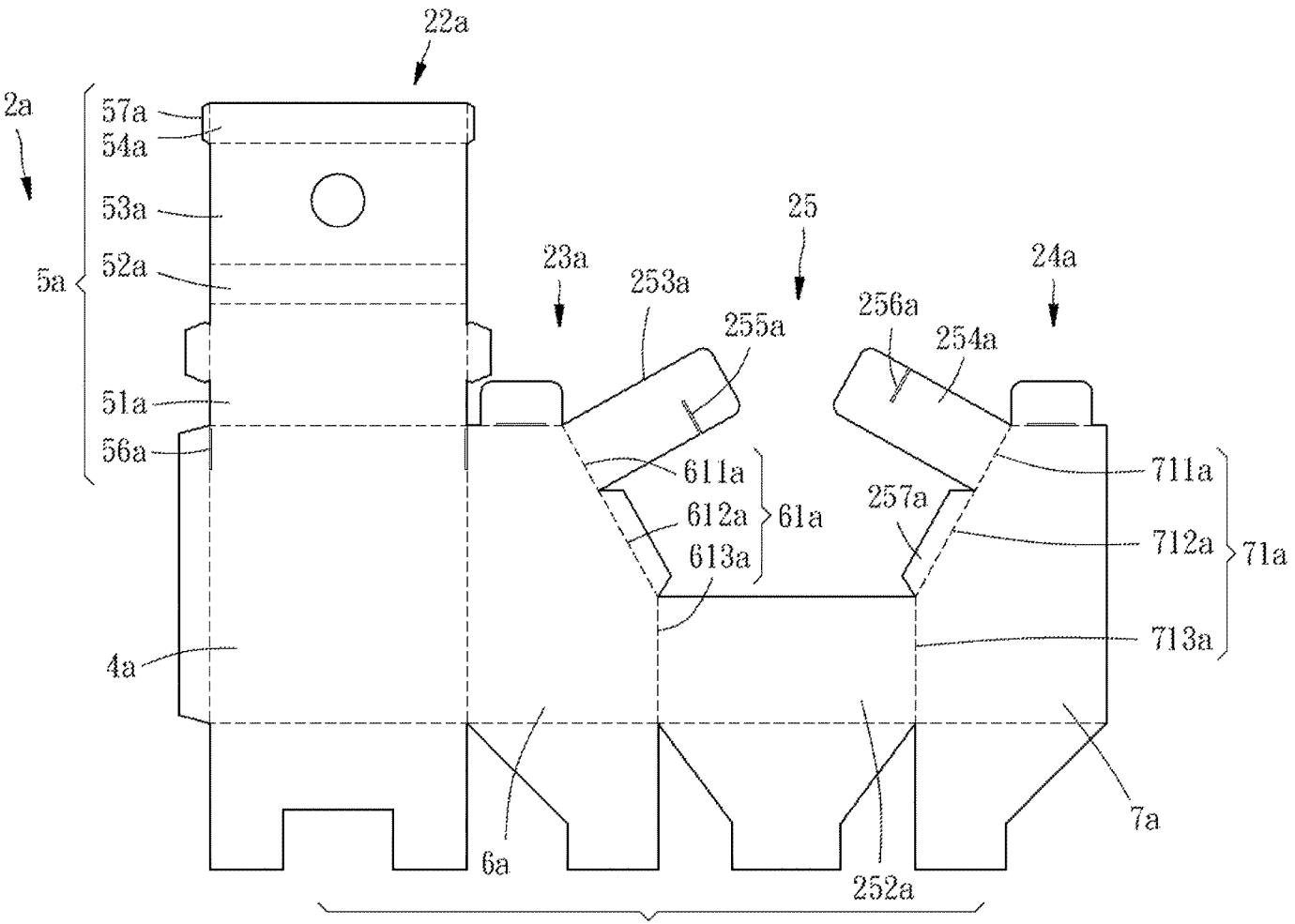
FIG. 8 is a top plan view illustrating a packaging blank for the display container according to FIG. 7.

The present disclosure relates to a display container 1 as represented in FIG. 1. The display container 1 is adapted for engaging an irregular article, such as a sprinkler timer device 100 (as illustrated in FIG. 8) having a slanted operation panel, which is revealed through an opening 11. Referring in FIG. 1, the opening 11 is made as large as possible in order to maximize viewing of the sprinkler timer device 100 or the specific face 101 thereof in order to reveal features of the sprinkler timer device 100 or the operation panel arranged on the specific face 101 for substantial tactile access.

The display container 1 according to the embodiments of the present disclosure will be described with reference to the drawings. Repeated description thereof may be omitted.

The display container 1 is accomplished via folding, and includes a rear panel 4, two side panels 6 and 7, two reinforcement arms reinforcing a connection between the two side panels 6 and 7, a first support structure 8, a second support structure 9, and a reception cavity 12. In reference with FIGS. 2, 2A, and 2B, the rear panel 4 defines a first transversal edge 41, a second transversal edge 42 opposite to the first transversal edge 42, and two lateral edges 43 and 44. The two side panels 6 and 7 are approximately symmetrical with each other, and each one defines a rear edge (no numeral designation) connecting a respective one of the two lateral edges 43 and 44 of the rear panel 4, a front edge 61 (71) opposite to the rear edge, a first edge (no numeral designation) corresponding to the first transversal edge 41 of the rear panel 4, and a second edge (no numeral designation, either) opposite to the first edge thereof and corresponding to the second transversal edge 42 of the rear panel 4. The first support structure 8 is disposed adjacent to the first transversal edge 41 of the rear panel 4 for enclosing the first edges of the two side panels 6 and 7; the second support structure 9 distances from the first support structure 8, and is disposed adjacent to the second transversal edge 42 of the rear panel 4 for enclosing the second edges of the two side panels.

First Embodiment

Figure 2:
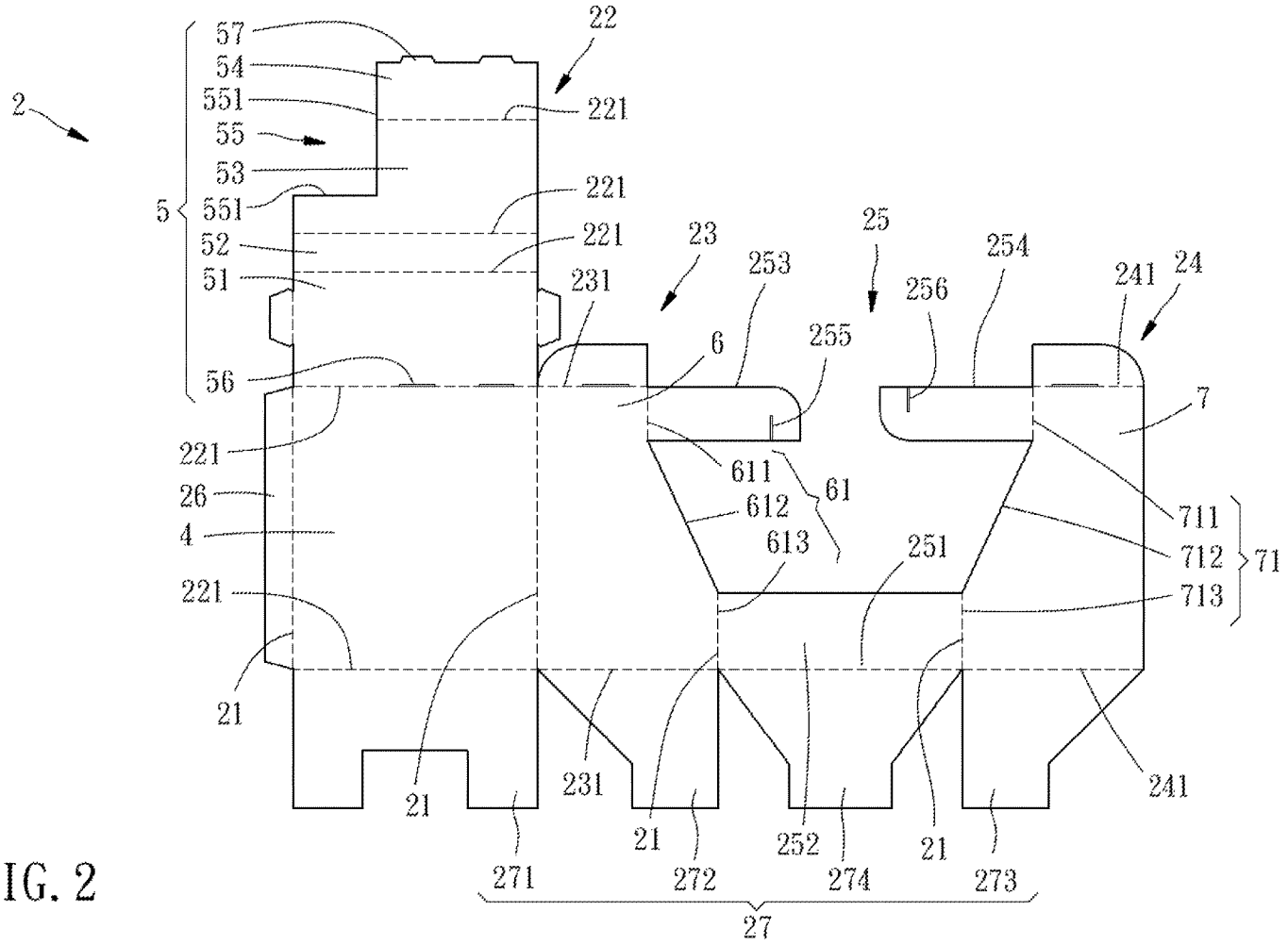
FIG. 2 is a top plan view illustrating a packaging blank for the display container according to FIG. 1.
Figure 2A:
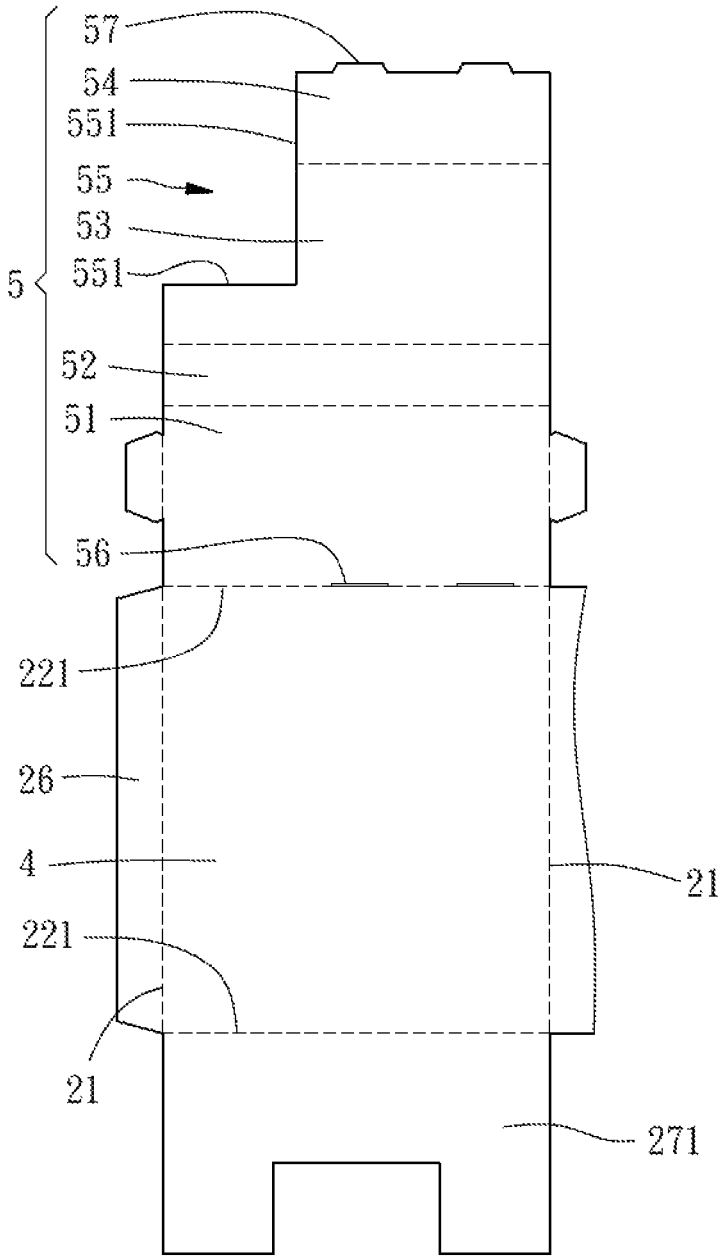
FIG. 2A is an enlarged view according to FIG. 2.
Figure 2B:
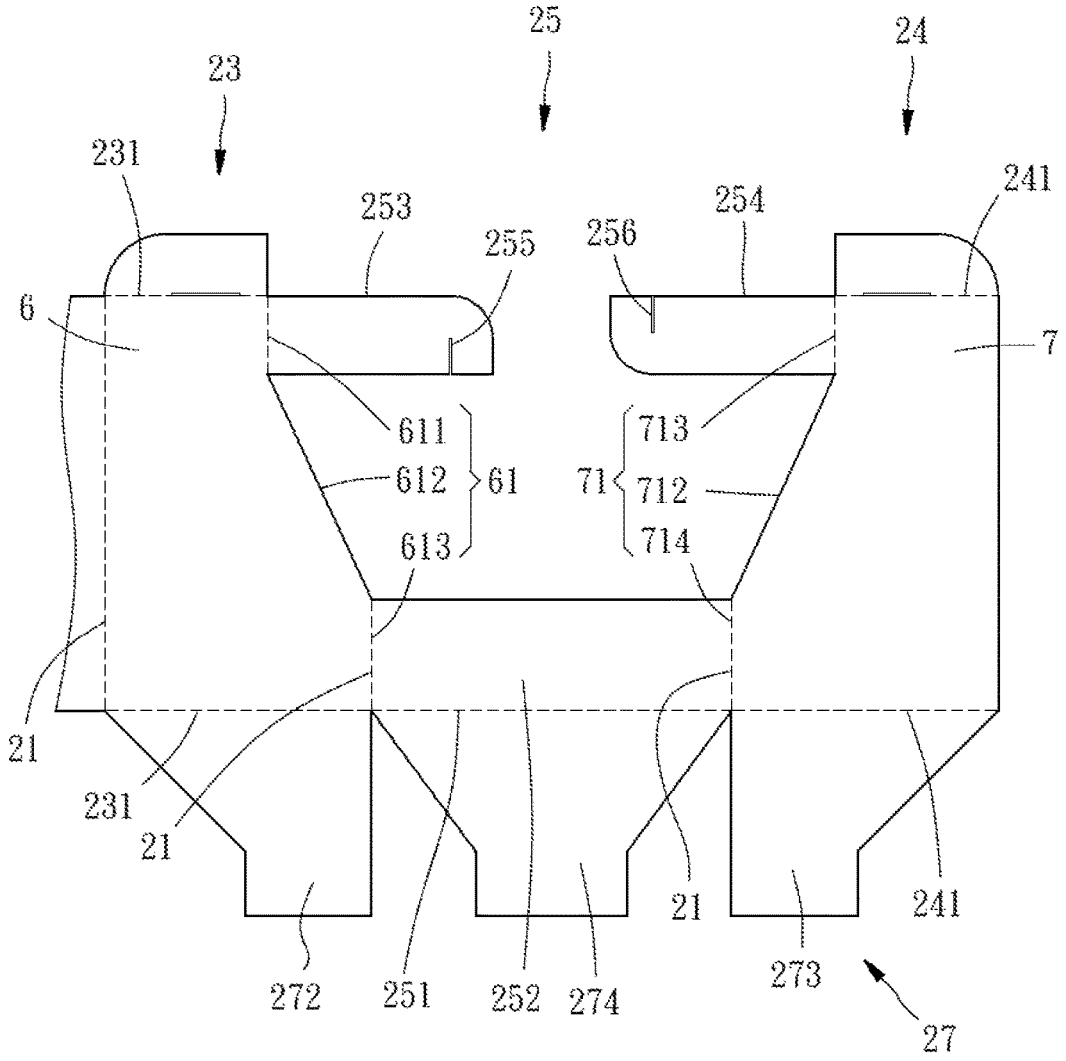
FIG. 2B is another enlarged view according to FIG. 2.
Figure 3:
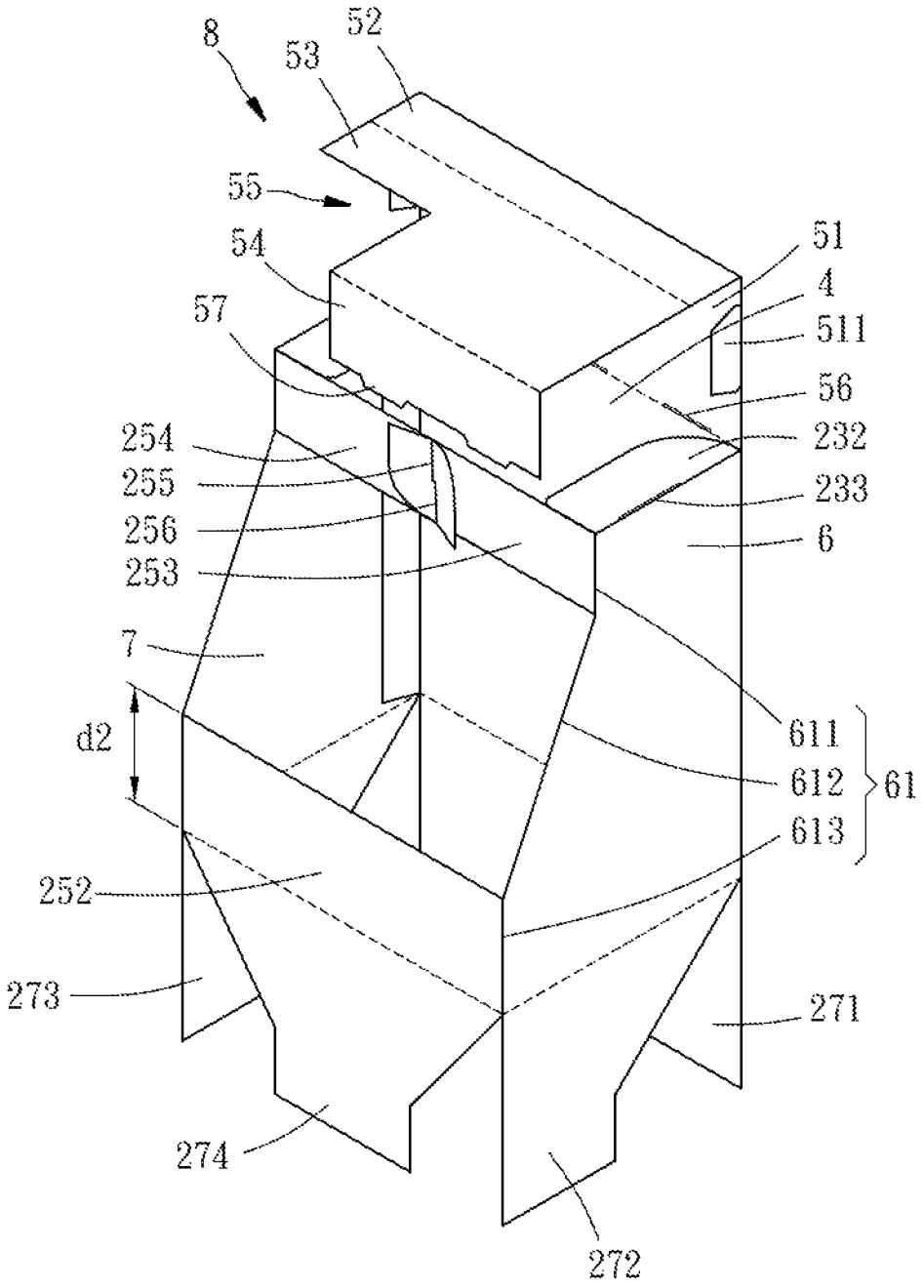
FIG. 3 is a perspective view illustrating folding process according to FIG. 2.
Figure 4:
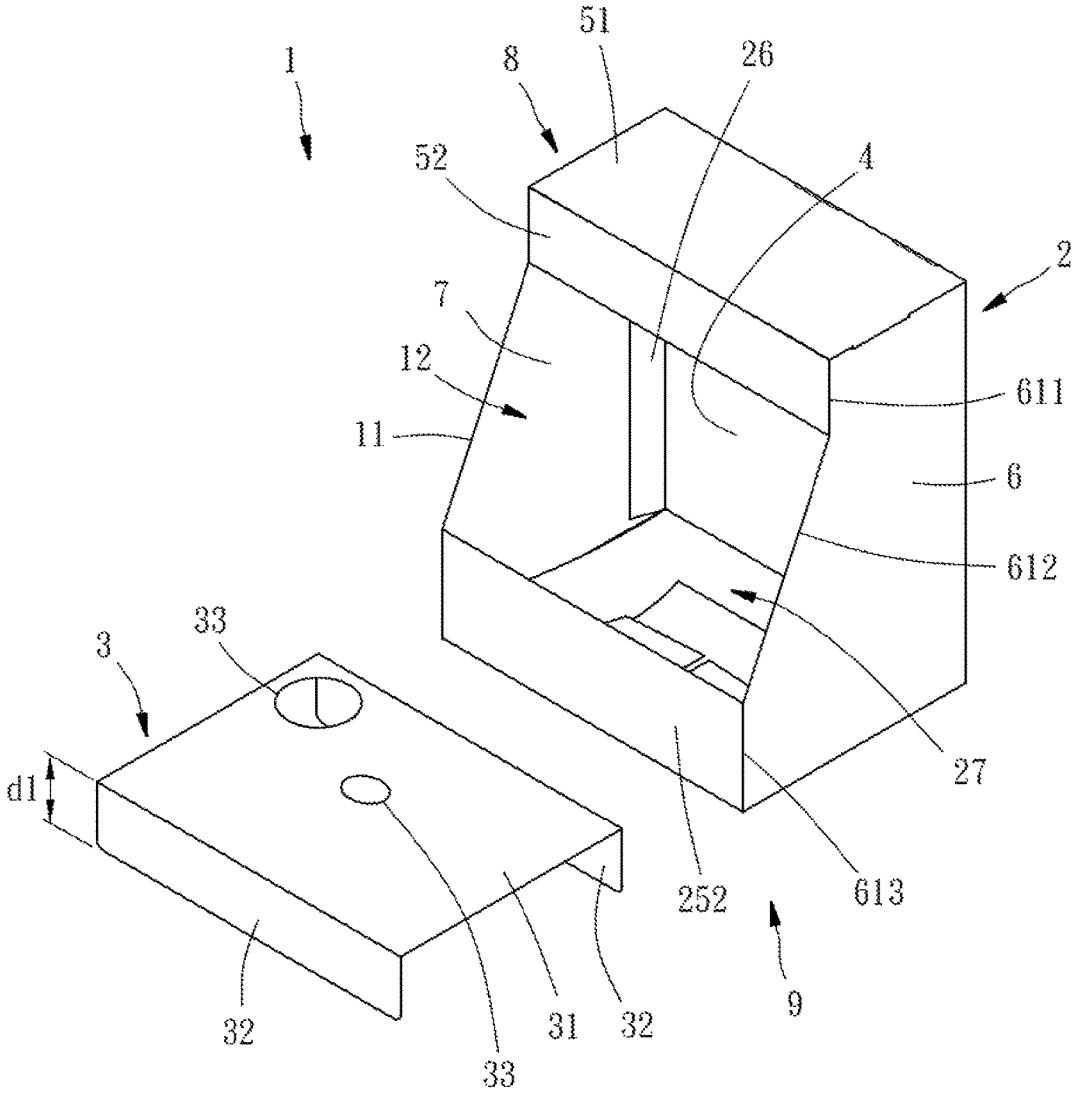
FIG. 4 is a perspective view illustrating folding process according to FIG. 1.
Figure 5:
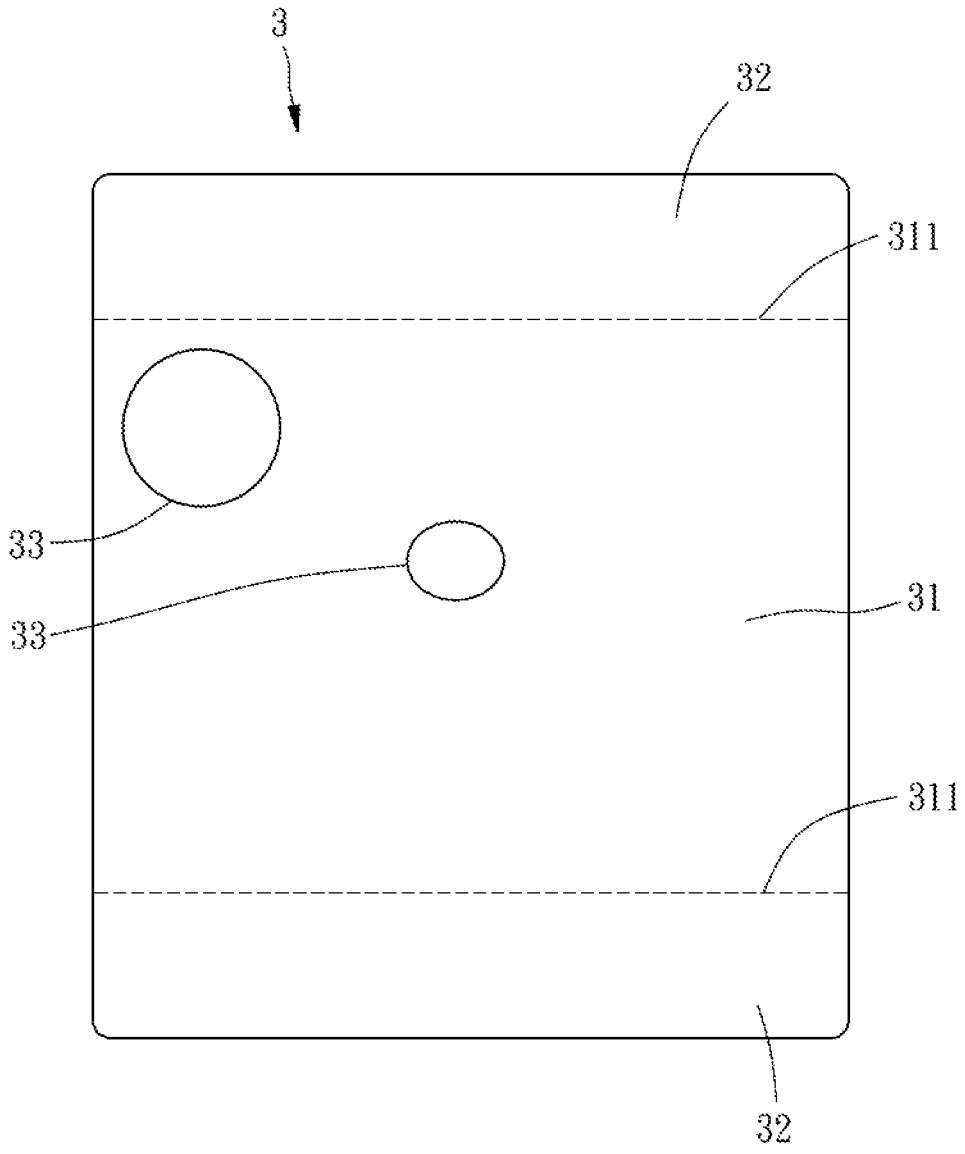
FIG. 5 is a perspective view illustrating a second packaging blank according to FIG. 4.
Figure 6:
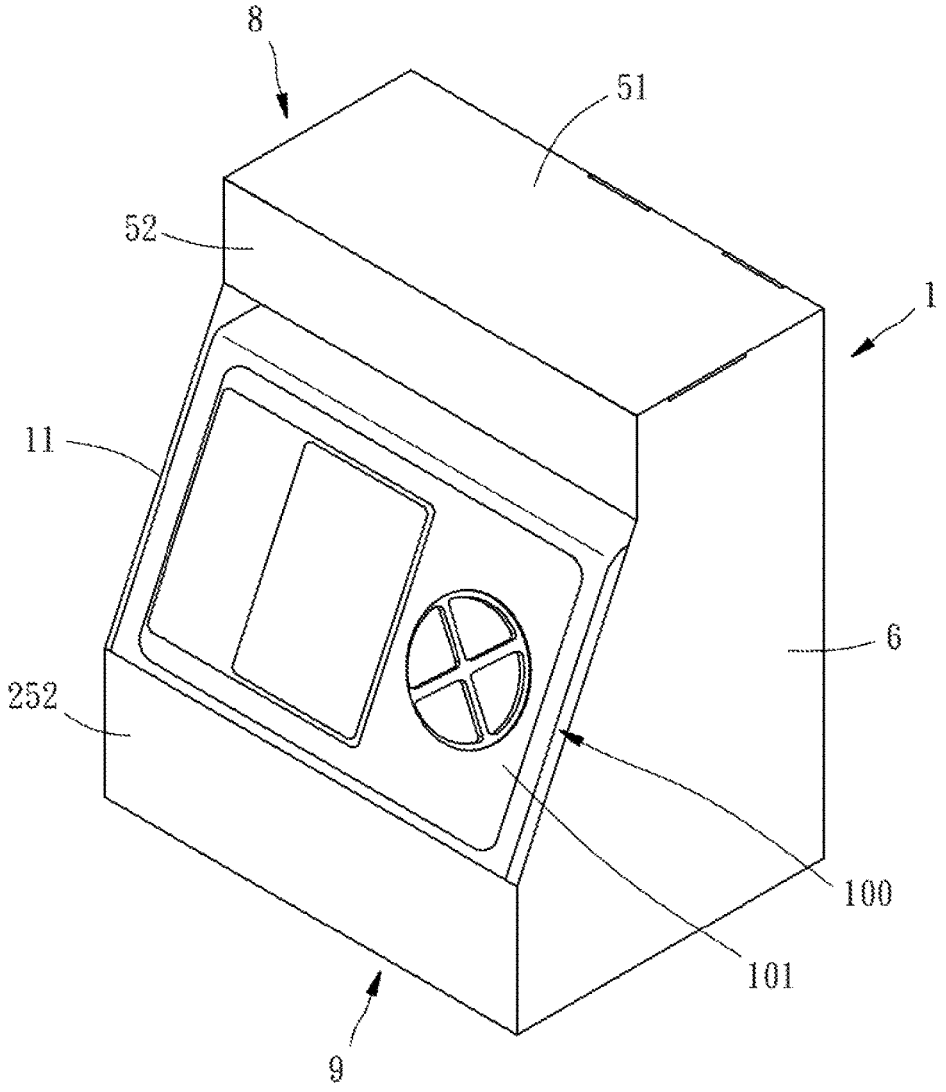
FIG. 6 is a perspective view illustrating the display container receiving a sprinkler timer device therein according to FIG. 1.

FIGS. 2, 2A, and 2B pertain to a packaging blank 2 used for constructing a first embodiment of the display container 1. The packaging blank 2 defines a plurality of sectional fold lines 21 intersected thereon to divide into a primary section 22, a right side section 23 and a left side section 24, a secondary section 25, and a glue flap 26. It would be easier to learn the packaging blank 2, if each section referring in FIG. 2 is described with at least a first edge, a second edge opposite to the first edge, and two lateral edges. The sectional fold lines 21 are parallel to one another.

The primary section 22 defines a plurality of primary fold lines 221, which are generally parallel to one another and perpendicular to the sectional fold lines 21. The primary fold lines 221 intersect the primary section to at least define the rear panel 4 and an extension sheet 5. The rear panel 4 defines the first transversal edge 41 overlying with one primary fold line 221, the second transversal edge 42 opposing with the first transversal edge 41 and overlying with another one primary fold line 221, and the two lateral edges 43, 44 overlying with two adjacent sectional fold lines 21 respectively. The extension sheet 5 extends from the first transversal edge 41 of the rear panel 4, and is spaced one another with predetermined distances via the primary fold lines 221 and intersected into a first planar panel 51 extending from the first transversal edge 41 of the rear panel 4, a face panel 52 extending from the first planar panel 51, a first interior panel 53 extending from the face panel 52, and a foot flap 54 extending from the first interior panel 53. A constraining member 55 is arranged to the first support structure 8 and binding a respective one projection of the article 100 therein, and particularly in this case the constraining member 55 is a cutout formed on the first interior panel 53. Two tongue slits 56 are formed around at least one corner where the rear panel 4 meets one of the two side panels 6, 7, or where the first planar panel 51 meets the face panel 52, and particularly in this case are formed adjacent to the first transversal edge 41 of the rear panel 4. Two tongues 57 disposes on an edge of the foot flap 54 and respectively register the tongue slits 56.

Upon completing folding and forming of the display container 1, the first support structure 8 is formed. The first support structure 8 is then formed by folding the foot flap 54, the first interior panel 53, the face panel 52, and the first planar panel 51 of the extension sheet 5 in order. The tongues 57 registers with the tongue slits 56, thereby helping the first support structure 8 keeping and retaining the shape itself. The foot flap 54 retains against the rear panel 4. Members 51 to 54 together enclose a hollow space (not shown) inside the first support structure 8, so that the respective one of the projections on the received device 100 is capable of reaching in.

The two side sections 23, 24 are approximately symmetrical to each other. One side section 23 connects the lateral edge 43 of the rear panel 4 and a respective one of the lateral edges of the secondary section 25, while the other side section 24 connects the other one of the lateral edges of the secondary section 25. Each side section defines a plurality of side fold lines 231 (241) which are generally parallel to one another and perpendicular to the sectional fold lines 21. Each side section 23 (24) at least define the side panel 6 (7). The front edge 61 (71) of each of the side panels 6 (7)

defines an upper segment 611 (711), an intermediate segment 612 (712) and a lower segment 613 (713). The upper segment 611 (711) and the lower segment 613 (713) in this case parallel with the sectional fold lines 21. At least one of the two side panels 6, 7 connects a respective one of lateral edges of the rear panel 4.

The secondary section 25 at least defines a second front panel 252 connecting lower segments 613 and 713 of the front edges 61 and 71 of the two side panels 6 and 7, and two reinforcement arms 253, 254 respectively extending from the front edges 61, 71 of the two side panels 6, 7 and interlocking with each other for being overlaid by the face panel 52.

A plurality of base forming flaps 27 respectively extend from the second edges of these sections 22~26 and register with one another to form a hold-up connection. The hold-up connection is a well-known art and will not be fully described here. The present embodiment as illustrated in FIG. 2A discloses a tuck-end configuration formed by a second planar panel 271 extending from the second transversal line 42 of the rear panel 4 and two dust flaps 272 and 273 extending from the second edges of the side panels 6 and 7.

Upon completing folding and forming of the display container 1, a second support structure 9 is formed. The second support structure 9 is at least formed by the second face panel 252, and the hold-up connection. In an alternative embodiment, a second packaging blank 3 is optionally arranged inside the second support structure 9. The second packaging blank 3 includes two foldable lines 311 intersecting itself into a second interior panel 31, and two retaining flaps 32 extending from opposite sides of the second blank 3, and at least one aperture 33 formed on the second interior panel 31. The aperture 33 is made for receiving a respective one of the projections on the received device 100.

The glue flap 26 joins any two adjacent sections together and is not limited to a specific type. The glue flap 26 is formed by folding via a respective one of the sectional fold lines 21, and extends from one of the followings: the rear panel 4, two side panels 6 and 7, and the second front panel 252. In this embodiment, the glue flap 26 extends from a respective one of the lateral edges of the rear panel 4.

A reception cavity 12 is constituted at least by the rear panel 4, the two side panels 6, 7, and the first support structure 8 after the folding is completed. The reception cavity 12 is capable of accommodating the article, such as the device 100 shown in FIG. 8. An opening 11 is bounded at least by the face panel 52, and the front edges 61 and 71 of the two side panels 6 and 7.

In an alternative embodiment (not illustrated), two foot flaps extend from the lateral edges of the first interior panel 53 and retains against the side panels 6, 7.

Second Embodiment

Figure 7:
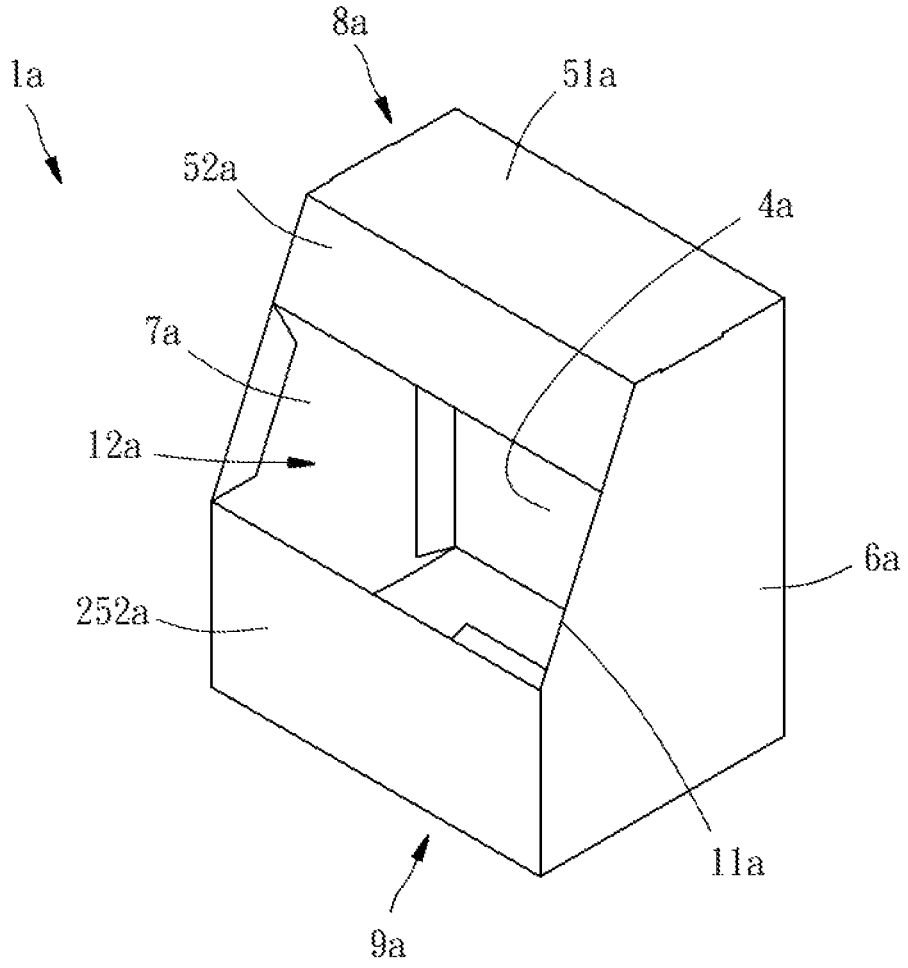
FIG. 7 is a perspective view illustrating a display container in accordance to a second embodiment of the present disclosure.

FIGS. 7 and 8 pertain to a packaging blank 2*a* used for constructing a second embodiment of the display container 1*a*. In the second embodiment, the upper segment 611*a* (711*a*) and the middle segment 612*a* (712*a*) parallel with each other, while the lower segment 613*a* (713*a*) parallels with the sectional fold lines 21.

The extension sheet 5*a* includes a first planar panel 51*a*, a face panel 52*a*, a first interior panel 53*a*, and a foot flap 54*a*. A constraining member 55*a* in this case is a through hole formed on the first interior panel 53, so as to communicate the hollow space in the first support structure 8*a* to the reception cavity 12*a*. Two tongue slits 56*a* are adjacent to sectional fold lines 21 between the primary section 22 and the two side sections 23, 24. Two tongues 57*a* extend from two opposite lateral sides of the foot flap 54*a* and are capable of aligning and registering with the two tongue slits 56*a*. The first support structure 8 thereby is kept in trapezoidal configuration.

Third Embodiment

Figure 9:
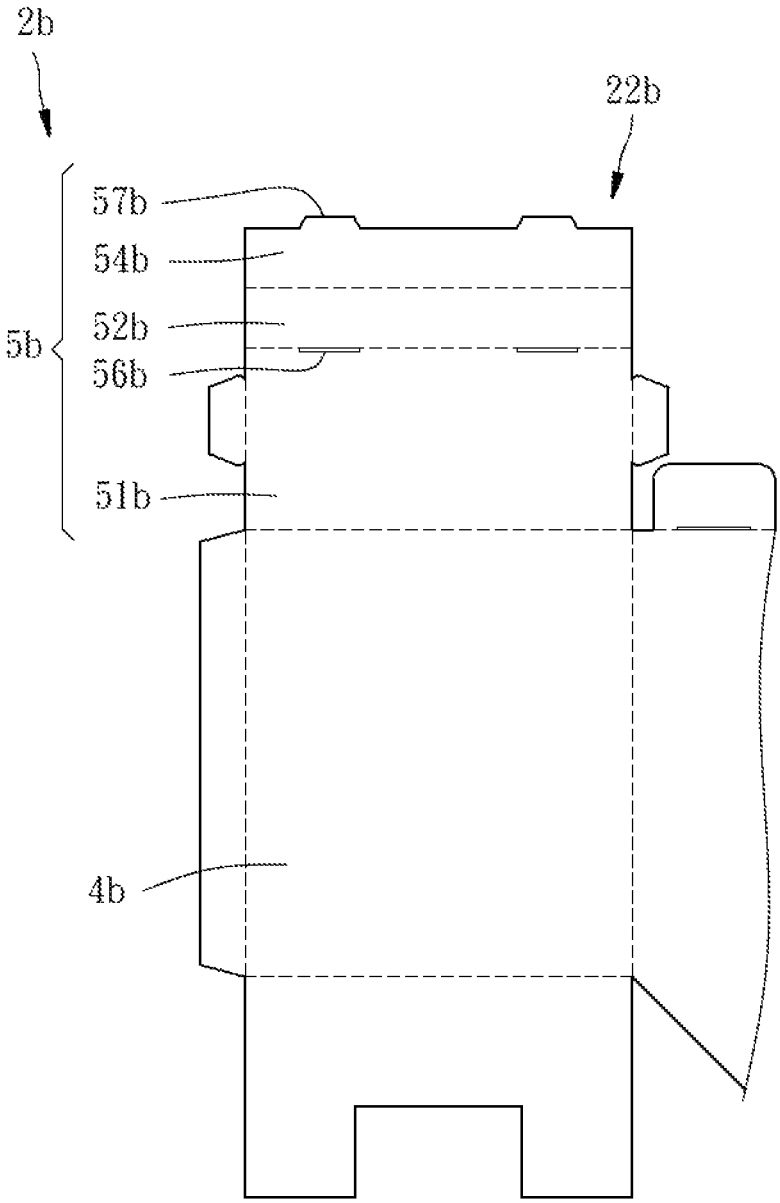
FIG. 9 is an enlarged view according to FIG. 2 illustrating a packaging blank for the display container in accordance to a third embodiment of the present disclosure.

FIG. 9 pertains to a partial packaging blank 2*b* used for constructing a third embodiment of the display container. In the third embodiment, a foot flap 54*b* extends from a face panel 52*b* directly. Two tongue slit 56*b* are formed on a first planar panel 51*b*, and two tongues 57*b* extend from the foot flap 54*b* and towards the first planar panel 51*b* for registering the tongue slit 56*b*.

In an alternative embodiment (not illustrated), for carrying a top of the irregular article, an auxiliary frame is optionally offered; such as the side panels of the first support structure is capable of extending extra panels to interconnect with each other, or an extra blank could adapte in the first support structure for carrying a top of the irregular article.

As described above, the display container 1 according to the present disclosure provides an aesthetically attractive container packaging with a substantial opening 11 while requiring minimal amount of additional base material, which is generally paper based.

In addition, the reinforcement arms hidden behind the face panel and the foot flap hidden inside the first support structure 8 increase the structural integrity of the display container 1. The reinforcement arms link the two side panels together and the foot flap abuts against any piece of the first support structure 8, both make the display container 1 difficult to open.

Furthermore, the opening 11 of the display container 1 allows a full view of the specific face of the device and sufficiently substantial touch by users, and further offers the opportunity for checking the product's quality which drives the purchase desire in modern markets. The display container 1 mentioned above according to the present disclosure still keeps the strength of the whole structure even though the opening 11 is made to be as large as possible, so that the display container can accommodate the article and still provide safe delivery.

The preceding description is meant to be illustrative of preferred embodiments and should not be construed as limiting the scope of the present disclosure. Various modifications, which would be readily apparent to one skilled in the art, are intended to be within the scope of the present disclosure. Accordingly, the only limitations to the scope of the present disclosure are set forth in the following claims appended hereto.

What is claimed is:

1. A display container constructed for carrying an article; the display container comprising:

a rear panel defining a first transversal edge, a second transversal edge opposite to the first transversal edge, and two lateral edges;

two side panels being approximately symmetrical with each other, wherein each of the side panels defines a rear edge connecting a respective one of the two lateral edges of the rear panel, a front edge opposite to the rear edge, a first edge, and a second edge opposite to the first edge;

a first support structure disposed adjacent to the first transversal edge of the rear panel for enclosing the first edges of the two side panels; the first support structure being folded via an extension sheet, where a plurality of primary fold lines are defined and generally parallel with one another; the primary fold lines intersecting the extension sheet and spacing one another with predetermined distances to define a first planar panel extending from the first transversal edge of the rear panel, a face panel extending and foldable from the first planar panel, and a foot flap paralleling with either the first planar panel or one of the side panels after completing folding the first support structure;

two reinforcement arms respectively extending from the front edges of the two side panels and interlocking with each other for being overlaid by the face panel; and a reception cavity being defined at least by the rear panel, the two side panels, and the first support structure, for accommodating the article therein.

2. The display container as claimed in claim 1, further including at least one tongue slit formed around a corner where the rear panel meets one of the two side panels or where the first planar panel meets the face panel, and at least one tongue disposed on an edge of the foot flap and registering the tongue slit; wherein the tongue slit is formed on a selective one among the rear panel, the two side panels and the first planar panel.

3. The display container as claimed in claim 2, wherein the tongue slit is adjacent to one of the two lateral edges edge of the rear panel, and the tongue extends from the foot flap and towards a respective one of the two side panels.

4. The display container as claimed in claim 2, wherein the tongue slit is formed on the first planar panel, and the tongue extends from the foot flap and towards first planar panel.

5. The display container as claimed in claim 2, wherein the tongue slit is adjacent to the first transversal edge of the rear panel, and the tongue extends from the foot flap and toward the rear panel.

6. The display container as claimed in claim 1, wherein the foot flap extends from the face panel.

7. The display container as claimed in claim 1, wherein the first support structure further includes a first interior panel extending and foldable from the face panel, and the foot flap extends from the first interior panel.

8. The display container as claimed in claim 7, wherein the foot flap is parallel with the first planar panel.

9. The display container as claimed in claim 7, wherein the foot flap is parallel with one of the side panels.

10. A display container formed by folding and comprising:

a packaging blank including:

a primary section having a plurality of primary fold lines generally parallel with one another and intersected thereon to at least define a rear panel and an extension sheet; the rear panel defining a first transversal edge, a second transversal edge opposing with the first transversal edge, and two lateral edges; the extension sheet extending from the first transversal edge of the rear panel, and being intersected into a first planar panel, a face panel extending from the first planar panel, a first interior panel extending from the face panel, and a foot flap extending from the first interior panel;

two side sections, each defining at least a side panel; wherein each of the side panels defines a rear edge, a front edge opposite to the rear edge, a first edge, and a second edge opposite to the first edge; wherein at least one of the rear edge connects a respective one of the two lateral edges of the rear panel;

a secondary section at least defining two reinforcement arms respectively extending from the front edges of the two side panels, wherein the two reinforcement arms are capable of interlocking with each other; and a glue flap; and a plurality of sectional fold lines set between any adjacent two of the primary section, the two side sections, the secondary section, and the glue flap.

11. The display container as claimed in claim 10, further including at least one tongue slit formed on a selective one of the rear panel and the two side panels, and at least one tongue disposed on an edge of the foot flap and registering the tongue slit.

12. The display container as claimed in claim 11, wherein the tongue slit is adjacent to one of the two lateral edges edge of the rear panel, and the tongue extends from the foot flap and towards a respective one of the two side panels.

13. The display container as claimed in claim 11, wherein the tongue slit is formed on the first transversal edge of the rear panel, and the tongue extends from the foot flap and towards the rear panel.

14. A display container formed by folding and comprising:

a packaging blank including:

a primary section having a plurality of primary fold lines generally parallel with one another and intersected thereon to at least define a rear panel and an extension sheet; the rear panel defining a first transversal edge, a second transversal edge opposing with the first transversal edge, and two lateral edges; the extension sheet extending from the first transversal edge of the rear panel, and being intersected into a first planar panel, a face panel extending from the first planar panel, and a foot flap extending from the face panel;

two side sections, each defining at least a side panel; wherein each of the side panels defines a rear edge, a front edge opposite to the rear edge, a first edge, and a second edge opposite to the first edge; wherein at least one of the rear edge connects a respective one of the two lateral edges of the rear panel;

a secondary section at least defining two reinforcement arms respectively extending from the front edges of the two side panels, wherein the two reinforcement arms are capable of interlocking with each other; and a glue flap; and a plurality of sectional fold lines set between any adjacent two of the primary section, the two side sections, the secondary section, and the glue flap.

15. The display container as claimed in claim 14, further including at least one tongue slit is formed on the first planar panel, and at least one tongue extends from the foot flap and towards first planar panel.

* * * * *